United States Patent [19]

Mowry

[11] Patent Number: 4,551,124

[45] Date of Patent: Nov. 5, 1985

[54] CORRUGATED BOX MACHINE GLUE APPARATUS

[75] Inventor: Donald E. Mowry, Norwalk, Ohio

[73] Assignee: Don Mowry Flexo Parts, Inc., Norwalk, Ohio

[21] Appl. No.: 463,570

[22] Filed: Feb. 3, 1983

[51] Int. Cl.[4] ..... B31B 1/62; B31B 3/60

[52] U.S. Cl. ..... 493/128; 493/132; 493/150; 493/333; 493/336; 493/479; 156/546; 156/548

[58] Field of Search ..... 493/128, 130, 131, 478, 493/479, 331, 333, 336, 150, 151; 74/903, 347, 348, 349; 156/356, 524, 546, 548, 574

[56] References Cited

U.S. PATENT DOCUMENTS

| | | | |
|---|---|---|---|
| 3,541,930 | 11/1970 | Goodrich | 493/130 |
| 3,608,390 | 9/1971 | Barrett | 74/348 |
| 4,262,582 | 4/1981 | Sugimoto et al. | 493/128 |
| 4,369,613 | 1/1983 | Gess | 493/478 |

OTHER PUBLICATIONS

Manual for a Model-701 Flexo Folder-Gluer, May 1975, S&S Corrugated Paper Machinery Co., Inc.

Valco Flexoseal Lap Gluing System, Valco, Cincinnati.

*Primary Examiner*—Daniel C. Crane

*Assistant Examiner*—David B. Jones

*Attorney, Agent, or Firm*—Emch, Schaffer, Schaub & Porcello Co.

[57] ABSTRACT

The application discloses a gluing apparatus for an adjustable machine for manufacturing corrugated boxes of a plurality of sizes. The apparatus includes an automatic glue dispensing head for applying glue to a corrugated box blank. The dispensing head is operatively connected to a mechanism for indexing the dispensing head towards and away from a centerline of the box manufacturing machine. The indexing mechanism is driven by a means operatively connected to an adjustable assembly station on the box manufacturing machine. Adjustment of the assembly station to produce a preselected size box correspondingly indexes the glue head towards or away from the centerline to a predetermined direction and distance from the centerline of the machine to apply glue to the box blank.

7 Claims, 5 Drawing Figures

CORRUGATED BOX MACHINE GLUE APPARATUS

BACKGROUND OF THE INVENTION

The invention relates generally to a corrugated box machine and apparatus for positioning a glue dispensing apparatus adjacent the edge of an unassembled corrugated box. More specifically, the invention is directed to an apparatus for adjusting the distance between the glue dispensing means and the edge of the corrugated box at the same time the mechanism for folding the box is being adjusted to accommodate a supply of boxes having different dimensions.

Normally, corrugated box assembly machines have many sections. Each section performs a specific function in the mass production of corrugated boxes. Corrugated stock is fed into an inking and scoring section. The corrugated stock is printed, scored for folding, and cut to form box flaps. The cut pieces proceed to a gluing section. Glue is applied to one edge of each box. The edges of the box are folded over on themselves along the score line in the folding section. The edge with the glue matingly engages the opposite edge. The folded box then proceeds to a stacking section where the boxes are transferred out of the corrugated box assembly machine.

Most of the functions of the prior art assembly machine are automated. The sides of the unassembled boxes are folded over on themselves by the use of a pair of conveyor belt assemblies. When corrugated boxes having a different dimension are to be produced, the distance between the parallel conveyor belt assemblies are automatically changed to accommodate the different position of the score line on the boxes. The glue dispensing means normally is stationed adjacent the front end of one of the conveyor belt assemblies. However, the glue dispensing means in prior art machines usually must be manually moved to the new position adjacent the leading edge of the corrugated box. Normally, this is a time consuming task. Often, a number of boxes must be produced before the location of the glue dispensing means is correct. If the glue dispensing means does not deposit glue at a precise location on the flap, the box will not be assembled correctly. For example, the flap will become glued to the middle of the box, missing the opposite edge altogether. Glue deposited too close to the edge of the flap causes a weak seal to be formed.

Thus, there is a need for a means for positioning the glue dispensing means in the correct position adjacent the edge of the unassembled box. There is a further need for a positioning means that can be moved to a new position simultaneously with the adjusting of the conveyor belt assembly.

SUMMARY OF THE INVENTION

The present invention is directed to apparatus for positioning a glue dispensing apparatus in the correct position adjacent the edge of an unassembled corrugated box. The positioning means includes a plurality of chain drive assemblies, drive shafts, and a sprocket means.

A first drive shaft is positioned within the folding section of the corrugated box assembly machine. The first drive shaft is operatively connected to a gear assembly. The gear assembly acts to move a first conveyor belt assembly to a new position for accepting a supply of corrugated boxes having different dimensions from the card board boxes previously produced.

A first chain drive assembly is also attached to the first drive shaft. The first drive shaft and the first chain drive assembly act to rotate a second drive shaft about its axis. The second drive shaft is positioned substantially perpendicular to a second conveyor belt assembly. The second drive shaft is operatively connected to the second conveyor belt assembly by a sprocket means.

The sprocket means matingly engages a key way in the second drive shaft. The second conveyor belt assembly can be slideably moved along the key way in the second drive shaft whether the second drive shaft is rotating about its axis or not. The sprocket means is operatively connected to a second chain drive assembly. The second chain drive assembly is operatively connected to a worm and to the second conveyor belt assembly. The second drive shaft and the second chain drive assembly act to rotate the driven worm about its axis. The driven worm extends from the second conveyor belt assembly and is substantially perpendicular to the second conveyor belt assembly. The glue dispensing means is operatively connected to the driven worm such that, as the driven worm is rotated, the glue dispensing means moves along the driven worm's axis.

In operation, the first drive shaft simultaneously acts to position the first conveyor belt assembly and to move the glue dispensing means along the driven worm. Since the second conveyor belt assembly is moved by means which are independent of the first drive shaft, the first conveyor belt assembly and the second conveyor belt assembly do not necessarily move simultaneously.

It is the object of this invention to provide an improved means for positioning the glue dispensing means in a correct position adjacent the edge of an unassembled corrugated box.

It is a further object of this invention to provide an improved positioning means that can be changed to a new position simultaneously with the adjusting of a conveyor belt assembly.

Other objects and advantages of the invention will become apparent as the invention is described hereinafter in detail and with references to the accompanying drawings.

DESCRIPTION OF THE PREFERRED EMBODIMENT

Figure 1:
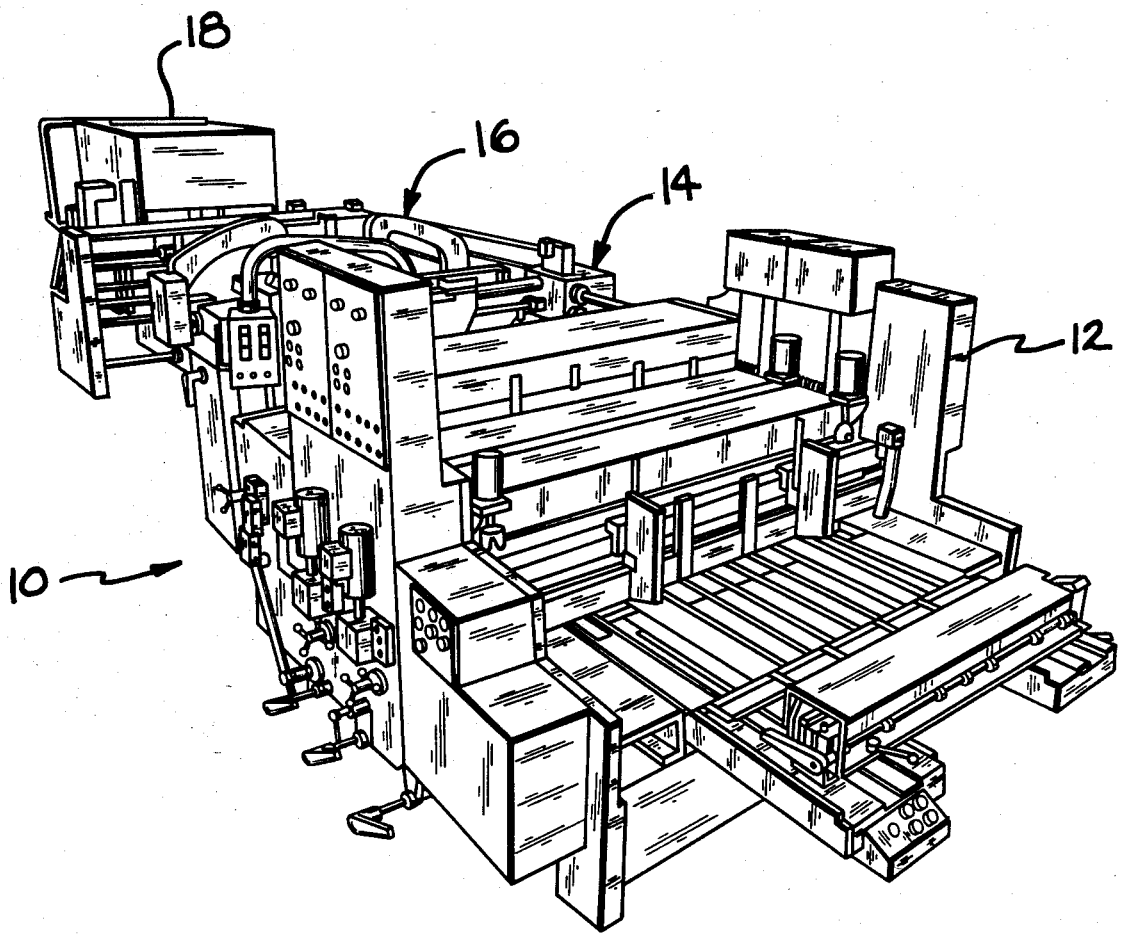
FIG. 1 is a perspective view of a corrugated box assembly machine.

Referring now to the drawings, and to FIG. 1 in particular, a typical corrugated box assembly machine 10 is shown. The machine 10 generally includes an inking and scoring section 12, a gluing section 14, a folding section 16, and a stacking section 18.

The corrugated stock (not shown) is fed into the inking and scoring section 12. The corrugated stock is printed, scored for folding, and cut to form box flaps. The corrugated proceeds to the gluing section 14. A bead of glue is applied to one edge of the box. A conveyor belt assembly 20 is positioned in substantially the center of the folding section 16. The outer edges of the box are folded over on themselves along the score lines and glued together. The folded box proceeds to the stacking section 18 where the boxes are transferred out of the assembly machine 10.

Figure 2:
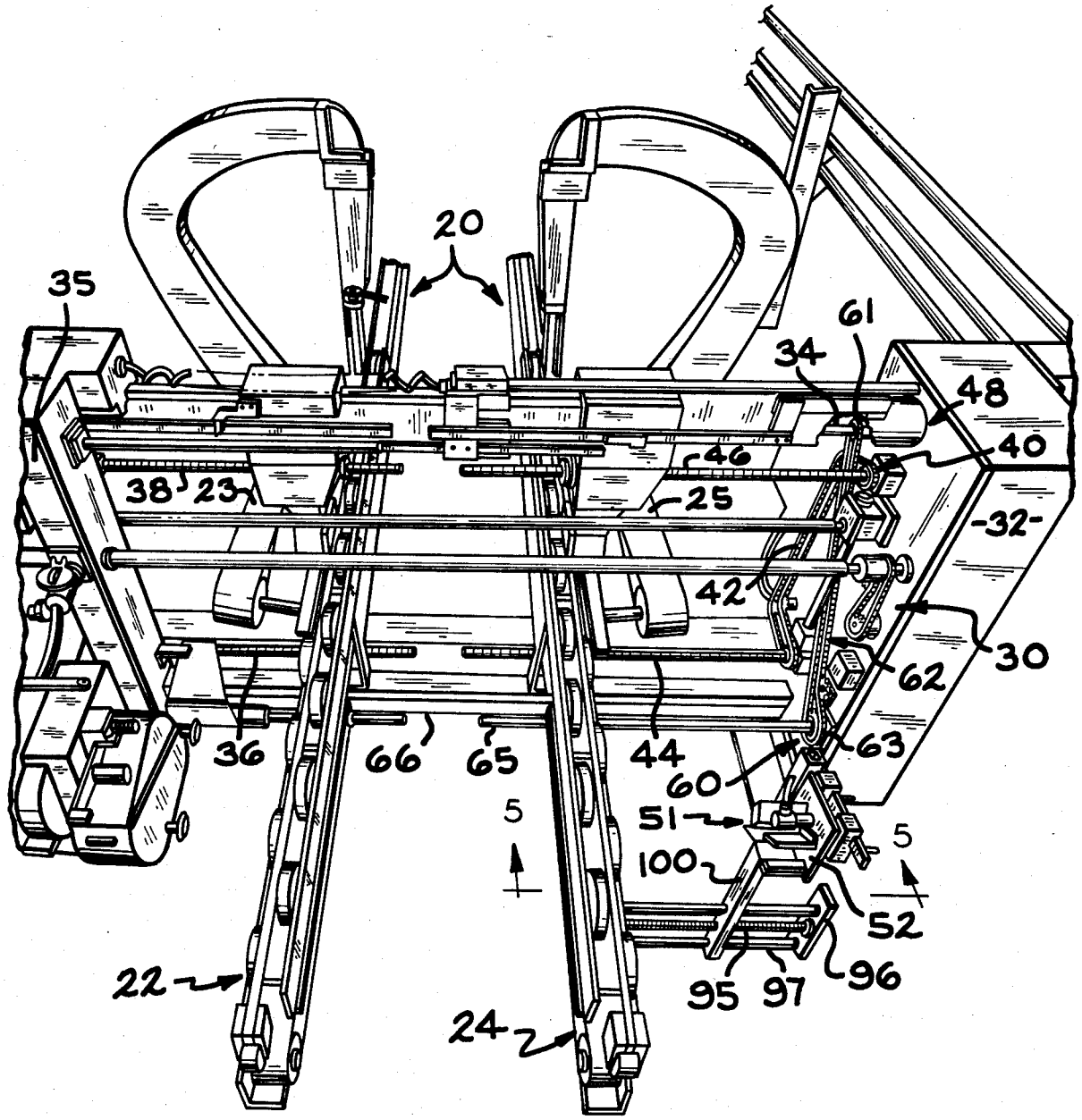
FIG. 2 is a fragmentary perspective view of the folding section of the FIG. 1 machine, showing a chain drive assembly and positioning apparatus and glue dispensing means according to the present invention.

The gluing section 14 is positioned adjacent the entrance of the folding section 16. The folding section 16, as shown in FIG. 2, includes a conveyor belt assembly 20. The conveyor belt assembly 20 consists of a first lower drive belt assembly 22 and a second lower drive belt assembly 24. The lower drive belt assemblies 22 and 24 are positioned in substantially the center of the folding section 16. The lower drive belt assemblies 22 and 24 are positioned substantially parallel to each other. The lower drive belt assemblies 22 and 24 are slideably mounted on a purality of threaded shafts 36, 38 and 44, 46. The distance between the lower drive belt assemblies 22 and 24 can be varied such that the assembly machine 10 can produce a supply of boxes with different dimensions.

The conveyor belt assembly 20 also includes a first upper drive belt assembly 23 and a second upper drive belt assembly 25. The upper drive belt assemblies 23 and 25 are positioned substantially adjacent the middle portions of the lower drive belt assemblies 22 and 24. The upper belt assemblies 23 and 25 act to engage the outer edges of a box (not shown), working the outer edges over on themselves along the score line. The folded and glued edges of the box are frictionally engaged by the upper and lower drive belt assemblies 22, 23 and 24, 25 such that the edges are securely glued together. The boxes are then transferred to the stacking section 18.

The folding section 16 includes a means 30 for adjusting the distance between the first and second drive belt assemblies 22, 23 and 24, 25. The adjustment means 30 is positioned adjacent the conveyor belt assembly 20. The adjustment means 30 acts to move the drive belt assemblies 22, 23 and 24, 25 to a precise, predetermined location such that the conveyor belt assembly 20 can accept a variety of sizes of corrugated boxes.

The adjustment means 30 includes a first gear assembly 32. The first gear assembly 32 is operatively connected to a first drive shaft 34. The first gear assembly 32 acts to rotate the drive shaft 34 about its axis. The drive shaft 34 is operatively connectd to a second gear assembly 35. The second gear assembly 35 is positioned in spaced apart relationship with the first gear assembly 32. The rotation of the drive shaft 34 activates the second gear assembly 35.

The second gear assembly 35 is operatively connected to shafts 36 and 38. The shafts 36 and 38 are positioned substantially perpendicular to the drive belt assemblies 22 and 23. The threaded shafts 36 and 38 are operatively connected to the drive belt assemblies 22 and 23. The second gear assembly 35 acts to rotate the threaded shafts 36 and 38 about their axes. The rotation of the threaded shafts 36 and 38 causes the drive belt assemblies 22 and 23 to selectively move in or out along the axes of shafts 36 and 38. The drive belt assemblies 22 and 23 are moved to a position to accept a box whose scorelines are different from those of the boxes which preceeded it in the assembly machine 10. The gear ratio in the second gear assembly 35 is such that the rotation of the threaded shafts 36, 38 causes the upper and lower first drive belt assemblies to move an equal distance.

The first gear assembly 32 includes a first chain drive assembly 40. The first chain drive assembly 40 generally includes a chain 42 and threaded shafts 44 and 46. The shafts 44 and 46 are positioned substantially parallel to each other and are in spaced apart relationship. The shafts 44 and 46 are positioned substantially opposite the shafts 36 and 38. The threaded shafts 44 and 46 are operatively connected to and are substantially perpendicular to the second lower and upper drive shaft assemblies 24 and 25. The chain drive assembly 40 acts to rotate threaded shafts 44 and 46 about their axes. The rotation of the threaded shafts 44 and 46 causes the drive belt assemblies 24 and 25 to move along the axes of shafts 44 and 46. The drive belt assemblies 24 and 25 are moved to a position to accept a load of corrugated boxes with different scorelines.

The assembly machine 10 includes a means 48 for positioning a glue dispensing means 50 in a precise, predetermined location adjacent the outer edge of the leading corrugated box. The positioning means 48 generally includes a second chain drive assembly 60, a second drive shaft 65, a sprocket means 70, a third chain drive assembly 90, and a driven worm 95.

The positioning means 48 is operatively connected to the first drive shaft 34 by the second chain drive assembly 60. The second chain drive assembly 60 includes a sprocket 61 co-axially placed around the drive shaft 34. The sprocket 61 engages a chain 62. The chain 62 engages a second sprocket 63. The sprocket 63 is co-axially placed around the second drive shaft 65. The second chain drive assembly 60 operatively connects the first drive shaft 34 to the second drive shaft 65 such that the rotation of the shaft 34 causes the shaft 65 to rotate.

The shaft 65 is substantially parallel to the shaft 34 and to the shafts 44 and 46. The drive shaft 65 is substantially perpendicular to the second lower drive belt assembly 24. The drive shaft 65 has a key way 66 extending longitudinally along the axis of the drive shaft 65. The drive shaft 65 is operatively connected to the second lower drive belt assembly 24 by the sprocket means 70.

The sprocket means 70 has a key 71 (shown in FIG. 4), which slideably engages the key way 66 in the drive shaft 65. The lower drive belt assembly 24 is slideably moved along the key way 66 by the first chain drive assembly 40. The lower drive belt assembly 24 can be moved along the key way 66 whether the shaft 65 is rotating or not.

Figure 4:
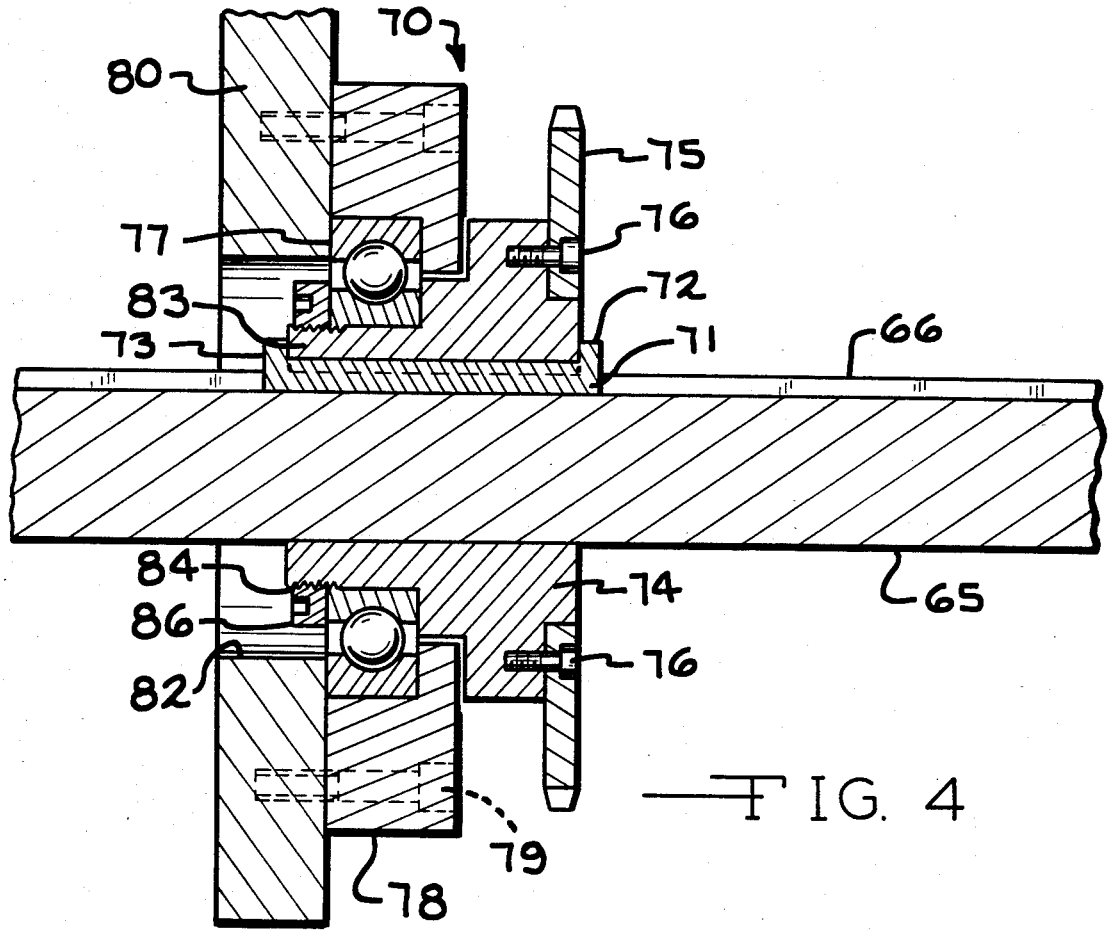
FIG. 4 is a fragmentary view, partially in cross section, taken along the line 4—4 in FIG. 3, showing a sprocket drive means.

Referring to FIG. 4, the key 71 has notches 72 and 73 positioned at each end of the key 71. The notches 72 and 73 act to prevent the key 71 from moving out of the key way 66. The key 71 is positioned adjacent a support member 74. The support member 74 is co-axially placed around the shaft 65. Sprocket 75 is co-axially placed around the support member 74. The sprocket 75 is attached to the support member 74 by a plurality of screws 76. The sprocket 75 is substantially perpendicular to the drive shaft 65. A ball bearing 77 is axially positioned in spaced apart relationship to the sprocket 75. The ball bearing 77 is axially positioned substantially adjacent the support member 74. The ball bearing 77 is substantially enclosed by a housing 78. The housing 78 is positioned substantially adjacent a side plate 80 and is attached to the side plate 80 by a plurality of bolts 79.

Figure 3:
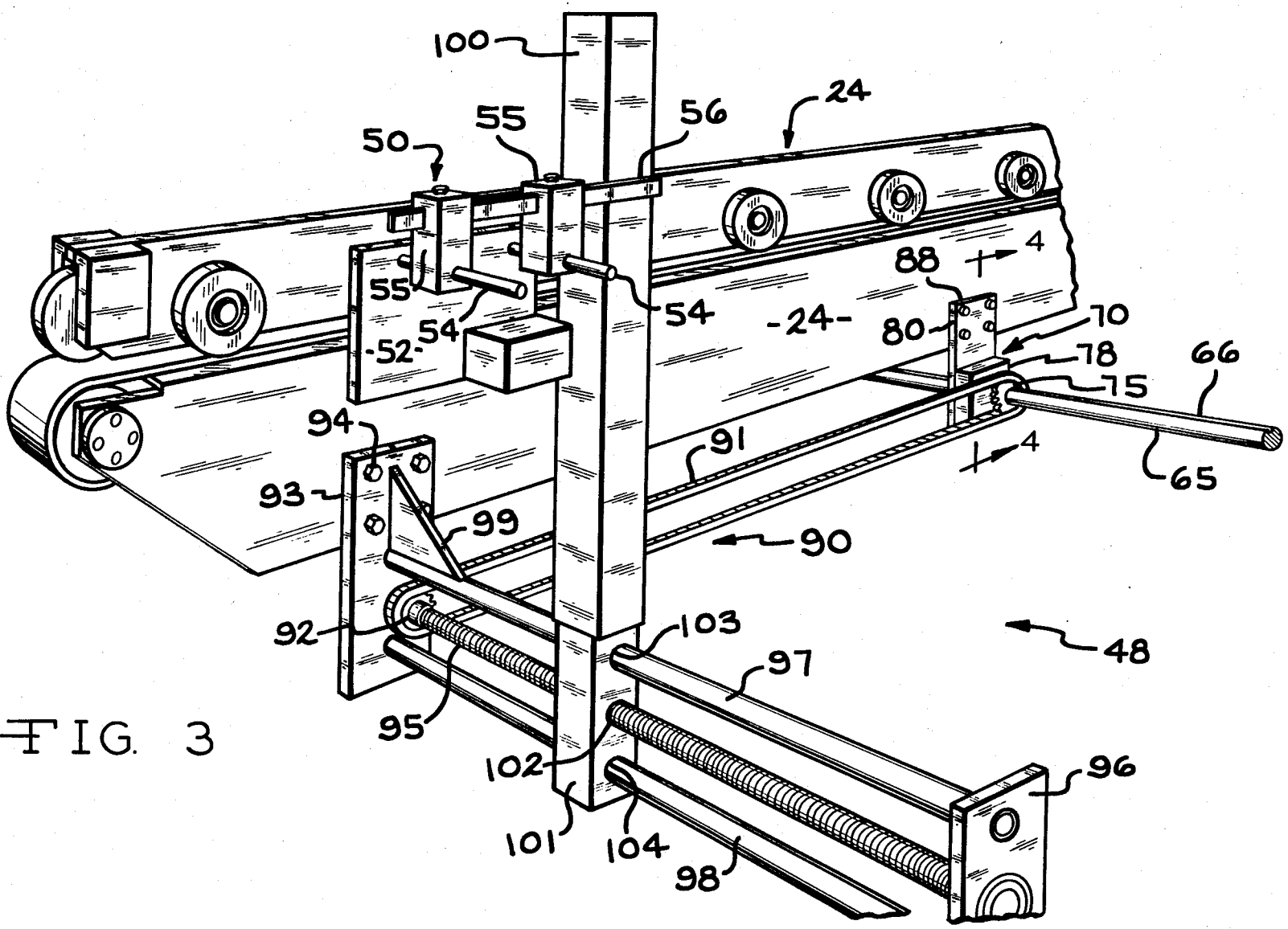
FIG. 3 is a fragmentary perspective view, taken on an enlarged scale showing the positioning apparatus and the glue dispensing means.

The side plate 80 includes an opening 82. The shaft 65 longitudinally extends through the opening 82. One end 83 of the support member 74 extends into the opening 82. The end 83 has a threaded surface 84. The threaded surface 84 engages a bearing lock nut 86. The bearing lock nut 86 is co-axially placed around the drive shaft 65 and engages the threaded surface 84. The bearing lock nut 86 acts to position the ball bearing 77 securely between the support member 74 and the housing 78. The side plate 80, as seen in FIG. 3, is attached to the second lower drive belt assembly 24 by a plurality of bolts 88. A third chain drive assembly 90 is operatively connected to the sprocket means 70. A chain 91 engages the sprocket 75. The chain 91 is positioned substantially adjacent the second lower drive belt assembly 24 and is substantially parallel to the second lower drive belt assembly 24. The chain 91 is operatively connected to a sprocket 92. The sprocket 92 is operatively attached to a side plate 93. The side plate 93 is mounted on the second lower drive belt assembly 24 by a plurality of bolts 94. The sprocket 92 is co-axially positioned on a driven worm 95.

The driven worm 95 is operatively attached to and is positioned substantially perpendicular to the second lower drive belt assembly 24. The driven worm 95 is spaced apart from and is substantially parallel to the drive shaft 65. The driven worm 95 terminates at an end plate 96. Guide rods 97 and 98 extend from the side plate 93 to the end plate 96. The guide rods 97 and 98 are positioned adjacent to and are substantially parallel to the driven worm 95. The glue dispensing means 50 is positioned on the worm 95 and the guide rods 97 and 98 by means of a support column 100. The support column 100 is substantially perpendicular to the driven worm 95 and the guide rods 97 and 98. The lower end 101 of the support column 100 is co-axially positioned within the support column 100. The lower end 101 has threaded opening 102. The driven worm 95 extends through the threaded opening 102. The lower end 101 has openings 103 and 104. The guide rods 97 and 98 extend through the openings 103 and 104. A brace 99 is positioned adjacent the side plate 93 and the guide rod 97. The brace 99 acts to provide support and stability for the glue dispensing means 50.

Figure 5:
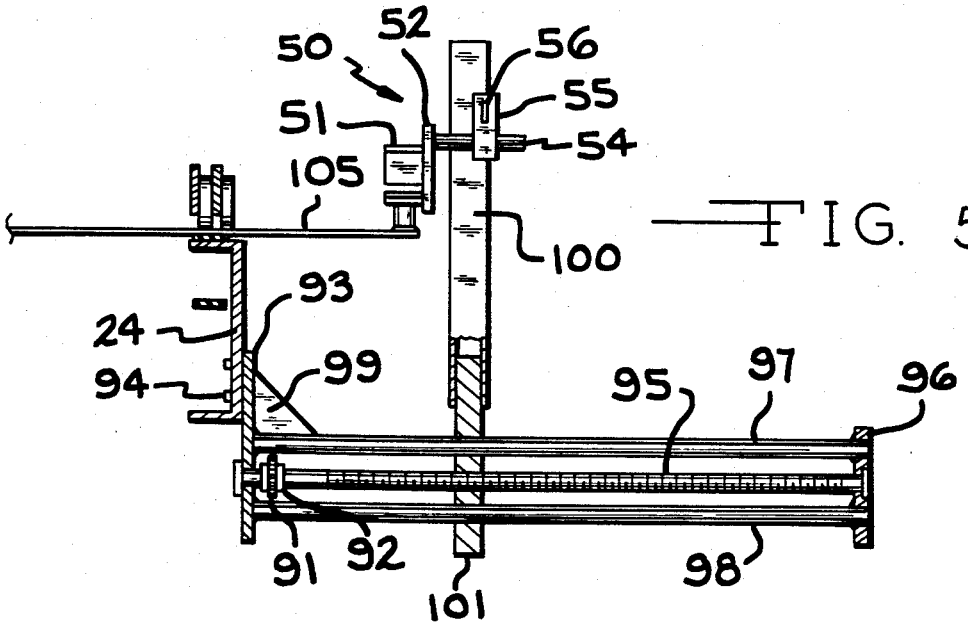
FIG. 5 is a fragmentary view, partially in cross section, taken along the line 5—5 of FIG. 2, showing a portion of the positioning apparatus and the glue dispensing means.

Referring to FIGS. 3 and 5, the glue dispensing means 50 generally includes a glue head 51 mounted on a panel 52. The panel 52 is mounted on rods 54 and support blocks 55. The support blocks 55 are attached to the support column 100 by means of a rod 56. The glue head 51 and the panel 52 slideably move along the rods 54. The support blocks 55 slideably move along the rods 56 such that the glue dispensing means 50 can be moved short distances, thus allowing fine adjustment of the glue dispensing means 50 relative to the edge of the unassembled box 105.

When the dimensions of the boxes to be assemblied are different from those already produced, the conveyor assembly 20 is adjusted. The first gear assembly 32 acts to rotate the first drive shaft 34, causing the first lower and upper drive belt assemblies 22 and 23 to move to a precise predetermined location. The rotation of the first drive shaft 34 also causes the second drive shaft 65 to rotate about its axis. The rotation of the second drive shaft 65 causes the third chain drive assembly 90 to rotate the driven worm 95 about its axis. The rotation of the driven worm 95 causes the support column 100 and the glue dispensing means 50 to move axially along the driven worm 95. The direction of movement of the glue dispensing means 50 along the driven worm 95 is opposite the direction of the movement of the first lower drive belt assembly 22. The gear ratio of the second gear assembly 35 and the driven worm 95 are such that the first lower drive belt assembly 22 and the support column 100 will move approximately equal, but opposite, distances.

The second lower drive belt assembly 24 is slideably moved along the key way 66 by the first chain drive assembly 40 to a new position. Thus, the movement of the first lower drive belt assembly 22 and the glue dispensing means 50 are independent of the movement of the second lower drive belt assembly 24.

The operation of the machine 10 is as follows:

For example, when the machine 10 is adjusted from producing a square box to producing a rectangular box having the dimensions of one side of the box equal to the dimensions of the square box, at least one of the conveyor belt assemblies must be adjusted. When the first belt assembly 22, 23 remains in the same position there is no rotation of the first drive shaft 34. Since the first drive shaft 34 does not rotate, there is no rotation of the second drive shaft 65 of the driven shaft 95. Since there is no rotation of the driven shaft 95, the glue dispensing means 50 remains in a fixed position on the driven shaft 95. The second belt assembly 24, 25 is axially moved along the key way 66 in the second drive shaft 65. The glue dispensing means 50 is passively carried to a new position by the second belt assembly 24, 25.

In another example, the dimensions of the boxes to be produced are different from the boxes previously produced such that the first belt assembly 22, 23 is moved and the second belt assembly 24, 25 remains stationary. There is no movement of the second belt assembly 24, 25 along the key way 66 in the second drive shaft 65. The first belt assembly 22, 23 is moved to a new position by the rotation of the first drive shaft 34. Rotation of the first drive shaft 34 causes rotation of the second drive shaft 65 and rotation of the driven worm 95. Rotation of the driven worm 95 about its axis causes the glue dispensing means 50 to be axially moved along the driven worm 95 to a predetermined position.

In a further example, both belt assemblies 22, 23 and 24, 25 are adjusted. The second belt assembly 24, 25 is moved along the key way 66 in the second drive shaft 65. The second belt assembly 24, 25 carries the glue dispensing means 50 with it. The first belt assembly 22, 23 is moved by the rotation of the first drive shaft 34. Rotation of the first drive shaft 34 causes rotation of the second drive shaft 65 and driven worm 95, and causes movement of the glue dispensing means 50 along the axis of the driven worm. Thus, as the second belt assembly 24, 25 moves in one direction along the key way 66 in the second drive shaft 65, the second drive shaft 65 and the driven worm 95 cause the glue dispensing means to move in the opposite direction.

The above detailed description of the invention is given only for the sake of explanation. Various modifications and substitutions other than those cited, can be made without departing from the scope of the invention as defined in the following claims.

What I claim is:

1. A gluing apparatus for an adjustable machine for manufacturing corrugated boxes of a plurality of sizes comprising: a first conveyor belt means and a second conveyor or belt means, said first and second conveyor belt means being adjustably spaced from one another to convey varying sizes of boxes, adjustment means operatively connected to said first and second conveyor belt means for adjusting the space between said first and second conveyor belt means, a glue dispensing means adjacent said second conveyor belt means for applying glue to the edge of corrugated board stock during the manufacture of a corrugated box and positioning means operatively connecting said glue dispensing means to said adjustment means for automatically re-indexing said glue dispensing means adjacent the edge of the corrugated board stock, when said adjustment means is activated, to accommodate different size corrugated board stock.

2. A gluing apparatus according to claim 1 wherein said adjustment means includes a first gear assembly, a first drive shaft, a second gear assembly, and a first chain drive assembly, said first drive shaft interconnecting said first gear assembly with said second gear assembly, said first chain drive assembly being operatively connected to said first gear assembly and to said second conveyor belt means and for adjusting said second conveyor belt means, said second gear assembly being operatively connected to said first conveyor belt means for adjusting said first conveyor belt means.

3. A gluing apparatus according to claim 2, wherein said positioning means includes a second drive shaft, a second chain drive assembly operatively connecting said first drive shaft of said adjustment means with said second drive shaft, said second drive shaft being substantially perpendicular to and passing through said second conveyor belt means, said second drive shaft being operatively connected to said second conveyor belt means by sprocket means such that said second conveyor means slideably moves along said second drive shaft, a driven worm threadingly engaging said glue dispensing means for movement of said glue dispensing means along said driven worm, said driven worm being operatively connected to said second conveyor belt means and a third chain drive assembly operatively connecting said sprocket means with said driven worm, whereby activation of said first drive shaft of said adjustment means causes said first conveyor belt means and said glue dispensing means to move in opposite and equal directions.

4. The gluing apparatus according to claim 3, wherein said sprocket means generally includes a sprocket, said sprocket being positioned axially on said second drive shaft, said sprocket being attached to a first end of a sprocket support member, said sprocket support member being axially positioned on said second drive shaft, said sprocket support member having a key means, said key means being substantially parallel to said second drive shaft, said key means being positioned in said key way in said second drive shaft, said key means having a first notch and a second notch, said first notch being positioned substantially adjacent said sprocket, said second notch being in opposed relationship to said first notch, said first notch acting to prevent said sprocket means from moving out of said key way, said sprocket support member having a ball bearing, said ball bearing being axially positioned on said sprocket support member, said ball bearing being in opposed adjacent relationship with said sprocket, said sprocket support member having a threaded end portion opposite said first end of said sprocket support member, said threaded end portion acting to engage a bearing lock nut, said bearing lock nut acting to position said ball bearing on said sprocket support member, said ball bearing being positioned within a housing, said housing being axially positioned about said sprocket support member, said housing being positioned substantially adjacent a side plate, said side plate being substantially perpendicular to said second drive shaft, said housing being attached to a first end of said side plate, said first end of said side plate having an opening, said second drive shaft and said sprocket support means axially extending through said opening, said side plate having a second end attached to said second conveyor belt means, said second conveyor belt means being slideably indexed along said second drive shaft by said first chain drive assembly to a predetermined position independent of the positioning of said glue dispensing means by the rotation of said second drive shaft.

5. A gluing apparatus according to claim 4, wherein said third chain drive assembly includes a sprocket coaxially positioned on said driven worm and a chain operatively connecting said sprocket of said third chain drive assembly with said sprocket of said sprocket means.

6. A gluing apparatus according to claim 5, wherein said driven worm further includes a plate and an end plate operatively connected to the opposed ends of said driven worm, said plate being attached to said second conveyor belt means and a plurality of guide rods connected to and extending between said plate and said end plate, said guide rods being substantially parallel to said driven worm.

7. A gluing apparatus according to claim 6, wherein said glue dispensing means includes a support column, said support column having a lower end, said guide rods and said driven worm extending through said lower end of said support column, said support column threadingly engaging said driven worm for movement along said driven worm upon activation of said third chain drive assembly and a glue head adjustably attached to said support column for dispensing glue along the edge of corrugated board stock during the manufacture of a corrugated box.

* * * * *